US006246036B1

(12) United States Patent
Tsujimoto et al.

(10) Patent No.: US 6,246,036 B1
(45) Date of Patent: Jun. 12, 2001

(54) INDUCTION HEATING FUSING DEVICE

(75) Inventors: Takahiro Tsujimoto; Akira Takasu, both of Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/631,352

(22) Filed: Aug. 2, 2000

(30) Foreign Application Priority Data

Aug. 6, 1999 (JP) ..... 11-224570

(51) Int. Cl.[7] ..... H05B 6/14; G03G 15/20

(52) U.S. Cl. ..... 219/619; 219/652; 219/670; 219/674; 219/676; 399/330; 399/336

(58) Field of Search ..... 219/619, 647, 219/652, 670, 672, 674, 676; 399/328, 330, 331, 335, 336

(56) References Cited

U.S. PATENT DOCUMENTS 5,970,299 * 10/1999 Sano et al. ..... 399/330
6,049,691 * 4/2000 Abe et al. ..... 219/619

FOREIGN PATENT DOCUMENTS 10-123862 5/1998 (JP) .

* cited by examiner

*Primary Examiner*—Philip H. Leung
(74) *Attorney, Agent, or Firm*—McDermott, Will & Emery

(57) ABSTRACT

The object of the present invention is to provide an induction heating fusing device in which the rotary heating member, such as a fusing roller or fusing belt, may be easily replaced. In order to attain this objective, the induction heating fusing device has a core, which forms a closed magnetic circuit, that comprises a first core component that runs though the empty space of the fusing roller, and a second core component that exists outside the empty space of the fusing roller, said core components being separable. The fusing roller, first core component and induction coil are housed in a casing, and comprise a fusing unit that may be replaceably mounted to the main unit of an image forming apparatus. During replacement of the fusing unit, the second core component remains in the image forming apparatus. The induction heating fusing device also has a pressurization means that causes the end surfaces of the first core component and the end surfaces of the second core component to be in pressure contact.

6 Claims, 2 Drawing Sheets

INDUCTION HEATING FUSING DEVICE

This application is based on application No. 11-224570 field in Japan, the contents of which is hereby incorporated by reference.

BACKGROUND OF THE INVENTION

1. Field of the Invention

The present invention pertains to a fusing device used in an image forming apparatus such as an electrophotographic copying machine, printer or facsimile, and more particularly, to a fusing device that fuses a toner image to a recording medium using low-frequency induction heating.

2. Description of the Related Art

An electrophotographic copying machine, printer or facsimile has a fusing device that fuses onto a sheet a toner image formed on the sheet, which comprises the recording medium. While various methods may be used by the fusing device, fusing devices using the induction heating method have been proposed in response to the recent demand for energy conservation.

For example, Japanese Laid-Open Patent application Hei 10-123862 discloses an induction heating fusing device in which a core that forms a closed magnetic circuit runs through a conducive fusing roller and a coil comprising spirally formed wire is coaxially located inside the fusing roller. In this fusing device, a magnetic flux is caused inside the core by supplying electric current to the coil, and the magnetic flux induces an inductive current in the fusing roller so that the fusing roller is heated by means of Joule heating.

Due to the direct heating of the heating member, such as the fusing roller, by means of electromagnetic induction, a fusing device using the induction heating method has higher heat conversion efficiency than the halogen lamp heating method. Consequently, the temperature of the surface of the fusing roller may be quickly increased to the fusing temperature using a smaller amount of power, thereby satisfying the demand for energy conservation. In particular, devices having a core that forms a closed magnetic circuit, as in the laid-open patent application described above, exhibits little leakage of the magnetic flux, and can efficiently induce a secondary electric current in the fusing roller, offering a high energy conservation effect. They are therefore suited for large high-speed copying machines and high-speed printers.

In the induction heating fusing device disclosed in the laid-open patent application referred to above, the core comprises a first iron core and a second iron core that is rotatably mounted to the first iron core, and the fusing roller may be mounted or removed by opening the first and second iron cores relative to each other.

Using this conventional induction heating fusing device, the fusing roller may be easily mounted or removed. However, because the mounting or removal of the fusing roller is performed by opening the first and second iron cores relative to each other, an operation that is somewhat complex for a general user must be performed. Therefore, an induction heating fusing device that allows the user to be able to replace the fusing roller more easily is desired.

OBJECTS AND SUMMARY

In view of the situation described above, the object of the present invention is to provide an improved induction heating fusing device.

Another object of the present invention is to provide an induction heating fusing device that allows easy maintenance.

Yet another object of the present invention is to provide an induction heating fusing device that allows easy replacement of the rotary heating member such as the fusing roller.

Yet another object of the present invention is to provide an induction heating fusing device through which the cost of replacement of the rotary heating member such as the fusing roller may be reduced.

In order to attain those and other objects, according to one aspect of the present invention, the induction heating fusing device has:

- a hollow rotary heating member that is made of a conductive material and heated based on induction heating;
- a rotary pressure member that is in contact with the rotary heating member and that holds between itself and the rotary heating member the recording medium carrying toner;
- a core that forms a closed magnetic circuit and that may be separated into a first core component that runs through the empty space of the rotary heating member and a second core component that is located outside the empty space of the rotary heating member,
- an inductive coil that is located around the first core component and that heats the rotary heating member based on induction heating;
- a casing that holds the rotary heating member, the first core component and the inductive coil; and
- a support mechanism that supports the casing holding the rotary heating member, the first core component and the inductive coil so that it may be separated and removed from the second core component.

Using this induction heating fusing device, the core, which forms a closed magnetic circuit, comprises first and second core components that may be separated from each other, and the casing that holds the rotary heating member and the first core component, as well as the inductive coil, may be separated and removed from the second core component. Therefore, when the rotary heating member is replaced, it is not necessary to remove the second core component, and the weight of the unit that must be removed (the rotary heating member, the first core component, the inductive coil and the casing) is reduced. In addition, since the complex operation to open the cores referred to with regard to the conventional induction heating fusing device is not necessary, the rotary heating member may be replaced more easily. Furthermore, since the second core component is repeatedly used, the unit price of the fusing device may be reduced in comparison with the situation in which the entire core is replaced.

Moreover, according to another aspect of the present invention, the induction heating fusing device also has a pressure mechanism that places the end surfaces of the first core component and the end surfaces of the second core component in pressure contact with each other.

Using this mechanism, because the end surfaces of the first core component and the end surfaces of the second core component are pressed onto each other without a gap in between, the magnetic resistance of the entire core does not increase and the rotary heating member may be efficiently heated, leading to a larger energy conservation effect.

BRIEF DESCRIPTION OF THE DRAWINGS

These and other objects and features of the present invention will become apparent from the following description of a preferred embodiment thereof taken in conjunction with the accompanying drawing, in which.

In the following description, like parts are designated by like reference numbers throughout the several drawing.

DETAILED DESCRIPTION OF THE PREFERRED EMBODIMENTS

Figure 1:
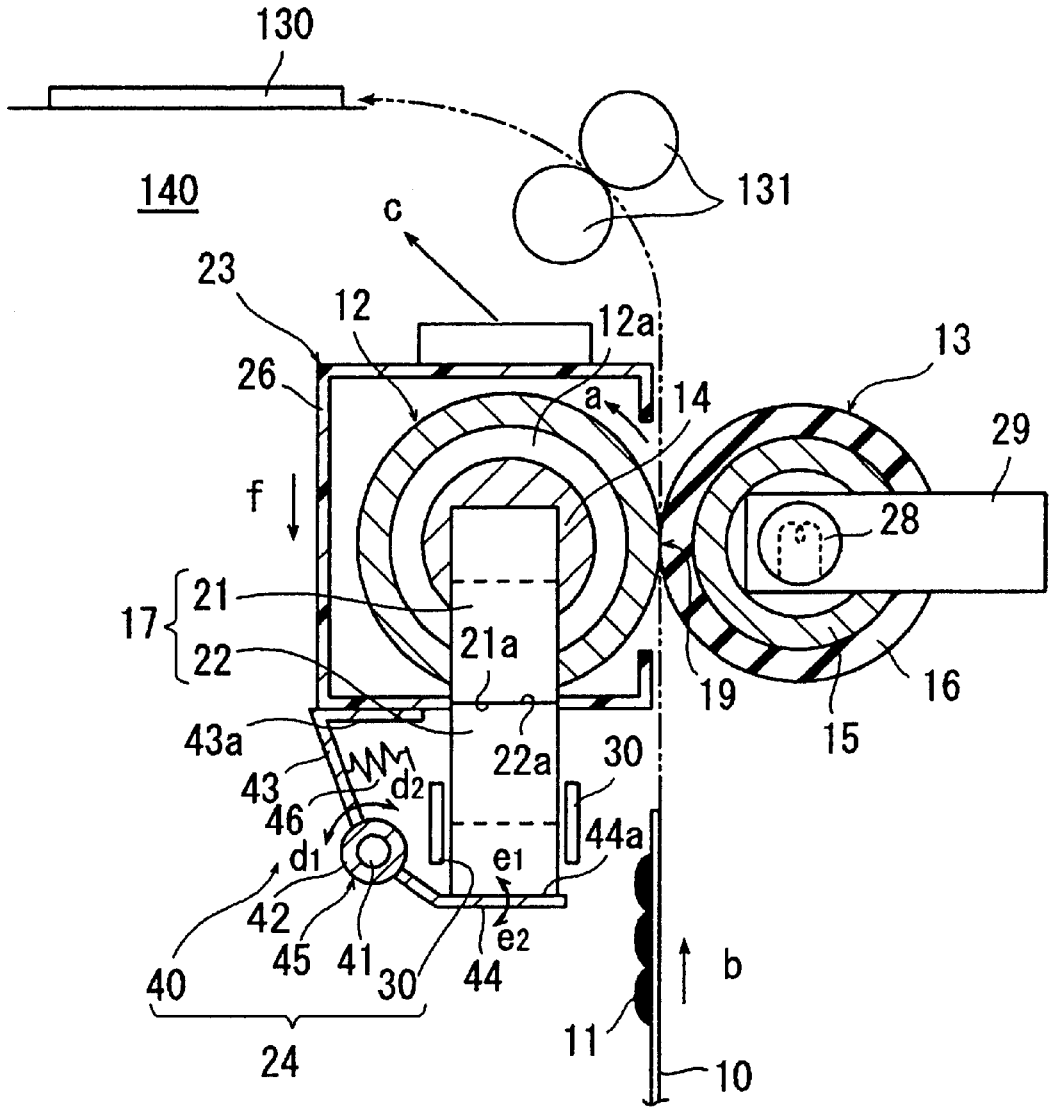
FIG. 1 is a cross-sectional view showing the basic construction of the induction heating fusing device.
Figure 2:
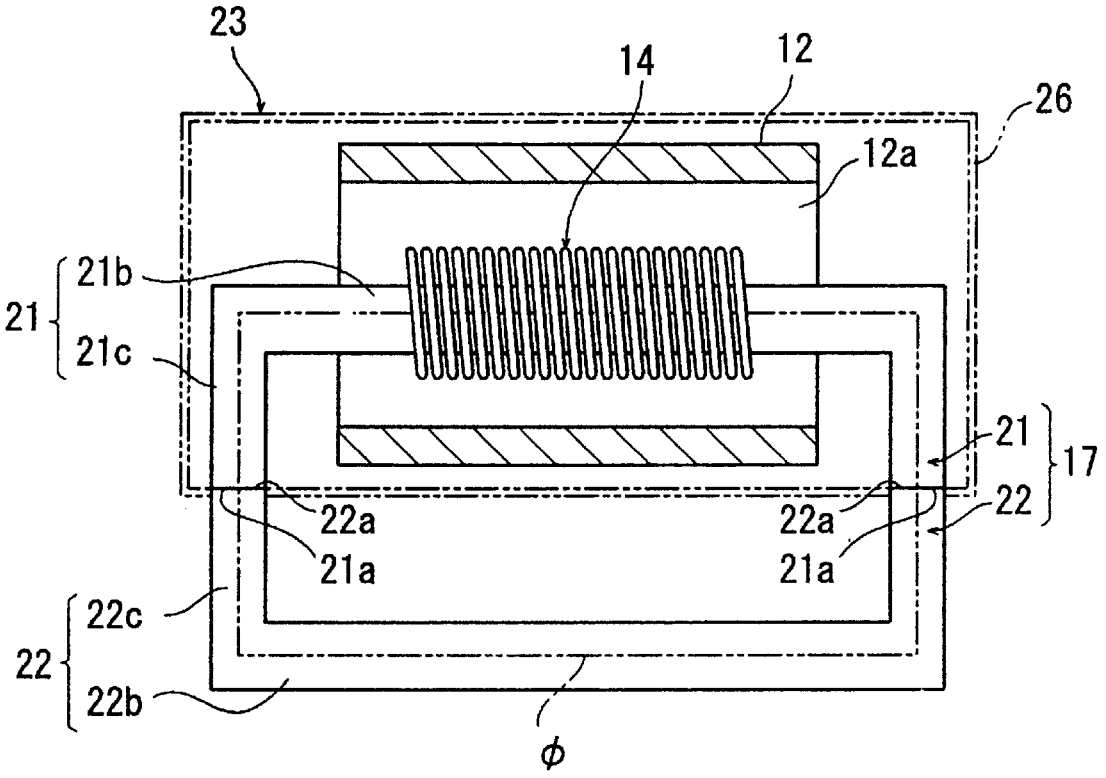
FIG. 2 is a cross-sectional view showing the construction of the interior of the fusing roller.

FIG. 1 shows a basic construction drawing showing a fusing device 140, and FIG. 2 is a cross-sectional view showing the interior of the fusing roller.

The fusing device 140 is incorporated in an electrophotographic image forming apparatus such as a copying machine, printer or facsimile, and fuses the toner image 11 formed on the sheet 10, which comprises the recording medium, onto the sheet 10 by heating and melting the toner image. This fusing device 140 has a fusing roller 12 (the rotary heating member) that is heated based on induction heating, a pressure roller 13 (the rotary pressure member) that presses against the fusing roller 12, and a coil 14 that heats the fusing roller 12 through induction heating. The fusing roller 12 has a hollow cylindrical configuration, and part of the rectangular core 17, which forms a closed magnetic circuit, is inserted in the empty space 12*a* of the fusing roller 12. The fusing roller 12 is located such that it may rotate in the direction of the arrow (a) in FIG. 1, and the pressure roller 13 is turned as the fusing roller 12 rotates.

The fusing roller 12 comprises a conductive hollow cylindrical pipe, and is formed of carbon steel, stainless allow, aluminum, iron or nickel belt. It has a thickness that allows the fusing roller 12 to have sufficient mechanical strength to withstand the pressure from the pressure roller 13, as well the heat required to perform fusing. Furthermore, in order to facilitate the separation of the sheet 10, the outer surface of the roller is coated with fluororesin, so that a heat-resistant separation layer that easily separates from the toner is formed.

The pressure roller 13 comprises a core shaft 15 and a silicone rubber layer 16 formed around the core shaft 15. The silicone rubber layer 16 is a heat resistant rubber layer that allows easy separation of the sheet 10 from its surface. In the example shown in the drawings, a halogen lamp 28 supported by a support plate 29 is located inside the core shaft 15. The pressure roller 13 is pressurized toward the fusing roller 12 by means of a spring member not shown in the drawings.

The core 17 is divided into a first core component 21 that runs through the empty space 12*a* of the fusing roller 12 and a second core component 22 that exists outside the empty space 12*a*, said core components being separable. The coil 14 comprises a wire that is spirally wound around the first core component 21. The fusing roller 12, first core component 21 and induction coil 14 are housed in the casing 26, all of which comprise a fusing unit 23 that may be detachably mounted to the frame 104. This fusing unit 23 is supported by a support mechanism 24 such that it may be mounted to and removed from the frame 104. When the fusing unit 23 is replaced, the second core component 22 may be left in the frame and only the fusing unit 23 may be removed. Further, the support mechanism 24 causes the end surfaces 21*a* of the first core component 21 and the end surfaces 22*a* of the second core component 22 into pressure contact when the fusing unit 23 is mounted.

To explain in more detail, the first core component 21 comprises a piercing member 21*b* that runs through the empty space 12*a* of the fusing roller 12 and connecting members 21*c* that extend at a right angle from either end of the piercing member 21*b*. The second core component 22 comprises a return member 22*b* that faces and extends parallel to the piercing member 21*b* of the first core component 21 and connecting members 22*c* that extend at a right angle from either end of the return member 22*b*. These first core component 21 and second core component 22 together form a rectangular closed magnetic circuit by having the end surfaces 21*a* of the connecting members of the first core component 21 and the end surfaces 22*a* of the connecting members of the second core component 22 come into contact with each other. A pair of guide plates 30 is fixed to the frame of the image forming apparatus in which the fusing device 140 is incorporated, such that they vertically guide the second core component 22. The core components 21 and 22 are so-called iron cores used in ordinary transformers, and are formed by punching out layered steel plates having a high magnetic permeability. They may comprise iron cores made of layered silicone steel plates, for example.

For the wire to form the coil 14, a regular single lead wire that has a fusing layer and an insulating layer on the surface is used.

The fusing unit 23 may be replaced by removing it from the image forming apparatus from the direction of the arrow (c) in FIG. 1. The frame of the image forming apparatus has protrusions, which are not shown in the drawing, that engage with part of the casing 26 in order to fix the location of the mounted fusing unit 23. The first core component 21 is supported in the fusing unit 23 while its position relative to the fusing roller 12 is fixed and its end surfaces 21*a* face the end surfaces 22*a* of the second core component 22, such that the coil 14 is coaxially located inside the fusing roller 12.

An operating mechanism 40 is located below the position at which the fusing unit 23 is mounted. This operating mechanism 40 retracts the second core component 22 from the first core component 21 when the fusing unit 23 is removed, and presses the second core component 22 toward the first core component 21 when the fusing unit 23 is mounted.

The operating mechanism 40 has a moving member 45 that comprises a ring 42 that is rotatably supported on a shaft 41 fixed to the frame of the image forming apparatus, a first plate 43 that extends from the ring 42 toward the fusing unit 23, and a second plate 44 that extends from the ring 42 toward the second core component 22. The first and second plates 43 and 44 are made of a material having a spring property. The tip of the first plate 43 is bent such that a first contact surface 43*a* that comes in contact with the bottom surface of the casing 26 is formed. Similarly, the tip of the second plate 44 is also bent such that a second contact surface 44*a* that comes in contact with the bottom surface of the second core component 22 is formed.

The first and second plates 43 and 44 are fixed to the ring 42, and move with the shaft 41 as the fulcrum. When the first plate 43 rotates counterclockwise, i.e., in the direction of the arrow (d1), the second plate 44 moves in the direction of the arrow (e1), and when the first plate 43 rotates clockwise, i.e., in the direction of the arrow (d2), the second plate 44 rotates in the direction of the arrow (e2).

The operating mechanism 40 also has a spring 46 that pressurizes the first plate 43 to move the first plate 43 in the direction of the arrow (d2).

When the existing fusing unit 23 is removed for replacement, the first plate 43 rotates in the direction of the arrow (d2) with the shaft 41 working as the fulcrum due to the force of the spring 46 to return to its original state, and the first contact surface 43*a* is pushed up. As the first plate 43 rotates, the second plate 44 rotates in the direction of the arrow (e2) with the shaft 41 working as the fulcrum, and the second contact surface 44*a* separates from the second core component 22. As a result, the second core component 22 becomes free and moves downward from its own weight while being guided by the guide plates 30. Consequently, the second core component 22 retracts from the first core component 21.

On the other hand, when a new fusing unit 23 is mounted, the fusing unit 23 comes in contact with the first contact surface 43*a*, and the first plate 43 is pushed down such that it rotates in the direction of the arrow (d1) with the shaft 41 working as the fulcrum against the force of the spring 46. As the first plate 43 rotates, the second plate 44 rotates in the direction of the arrow (e1) with the shaft 41 as the fulcrum, and the second contact surface 44a rises. As a result, the second core component 22 moves up while being guided by the guide plates 30, and is pushed toward the first core component 21.

The fusing operation of the fusing device 140 will now be explained.

In the fusing operating, an alternating current having a 50–60 Hz frequency is impressed to the coil 14 from a power supply circuit not shown in the drawings. An induction current consequently flows in the fusing roller 12, and the fusing roller 12 is heated. The fusing roller 12 is heated in this way based on low-frequency induction heating until its temperature reaches a level that is appropriate for fusing (e.g., 150° C. to 200° C.). The sheet 10 carrying a non-fused toner image 11 is sent toward the nipping area 19, where the fusing roller 12 and the pressure roller 13 come into contact with each other. The sheet 10 is conveyed while being held in the nipping area 19 while the heat of the heated fusing roller 12 and the pressure from the pressure roller 13 are applied to it. Consequently, the non-fused toner 11 melts and subsequently hardens and bonds onto the sheet 10. The toner 11 is carried on the side of the sheet 10 that comes in contact with the fusing roller 12. The sheet 10 that has passed through the nipping area 19 naturally separates from the fusing roller 12 based on its own strength. It is then conveyed by the eject roller 131 and ejected onto the eject tray 130.

The basic operating principle of the induction heating fusing device is the same as in a transformer. The coil 14 is equivalent to the input side primary coil (N turns) while the fusing roller 12 is equivalent to the output side secondary coil (1 turn). When an AC voltage V1 having a 50–60 Hz frequency is impressed to the primary coil (the coil 14), a current 11 flows in the primary coil. Magnetic flux $\phi$ that is consequently generated flows in the core 17, thereby forming a closed magnetic circuit, an induction electromotive force V2 is generated in the secondary coil (the fusing roller 12) due to the magnetic flux $\phi$, and a current 12 flows in the fusing roller 12 around its circumference. Because a closed magnetic circuit is formed by the core 17, there is no magnetic flux leakage in theory, so that the primary side energy V1×11 and the secondary side energy V2×12 become essentially equal.

Heat generation that occurs in this system in which induction heating takes place comprises (1) the heat generation by the coil due to the copper loss in the copper wire of the primary coil (i.e., the heat generation by the coil 14), (2) the heat generation by the coil due to the copper loss in the copper wire of the secondary side coil (i.e., the heat generation by the fusing roller 12), and (3) the heat generation by the core 17 due to the Joule heat loss and hysterisis loss that are generated in the core. In the induction heating fusing device, because the first and third types of heat generation result in energy loss, they are reduced to the extent possible and the fusing roller 12 is made to generate heat using the second type of heat generation, i.e., copper loss.

Incidentally, since the separation layer of the fusing roller 12 has a limited life, the user or service person must replace the fusing unit 23 with a new one.

When the fusing unit 23 is replaced, the old fusing unit 23 is removed in the direction of the arrow (c). Then as the first contact surface 43*a* is pushed up due to the property of the spring 46 to return to its original state, the second contact surface 44*a* lowers, and the second core component 22 retracts from the first core component 21 while being guided by the guide plates 30. Therefore, the second core component 22 that remains inside the image forming apparatus does not obstruct the operation to remove the fusing unit 23.

When a new fusing unit 23 is mounted from the direction of the arrow (f), the first contact surface 43*a* is pushed down against the force of the spring 46. As this occurs, the second contact surface 44*a* rises, and the second core component 22 is pushed toward the first core component 21 while being guided by the guide plates 30, whereupon the replacement of the fusing unit 23 is completed.

As described above, since the core 17 comprises first and second core components 21 and 22, which may be separated from each other, and the second core component 22 remains on the side of the frame 104 when the fusing unit 23 is replaced, when compared with the conventional technology in which the fusing roller was mounted or removed by opening relative to each other the two iron cores, which are rotatably connected together, the fusing roller 12 may be replaced through the comparatively simple operation of removing or inserting the casing 26. Moreover, since not the entire core but only the first core component 21, which is a part of the core, is incorporated in the fusing unit 23, the fusing unit 23 as a whole may be made lightweight. Therefore, while in a so-called personal-use printer the user himself must replace the fusing unit 23, a consumable part, using this embodiment, the ease of the operation to replace the fusing unit 23 is significantly improved.

In addition, because the second core component 22 remains on the side of the frame 104 and is repeatedly used, the unit price of the fusing unit 23 may be reduced relative to the situation in which the entire core is replaced.

Furthermore, where the fusing unit 23 is already mounted, because the second core component 22 is pushed toward the first core component 21 by means of the operating mechanism 40, the end surfaces 21*a* of the first core component 21 and the end surfaces 22*a* of the second core component 22 are in pressure contact without any gaps in between. Since no gaps exist between the core components 21 and 22, the magnetic resistance of the core as a whole does not increase, and therefore iron loss does not increase. Consequently, where the amount of power allocated to the induction heating fusing device 140 is limited, the heat generation amount based on the secondary copper loss that generates heat in the fusing roller 12 does not decrease, so that the fusing roller 12 may be efficiently heated and the energy conservation effect may be further increased.

The explanation provided above concerned an embodiment in which a fusing roller 12 was used as the rotary heating member, but the present invention is not limited to this example. For example, the rotary heating member may comprise a fusing belt that is suspended over multiple rollers.

The explanation provided above concerned an embodiment in which the core 17 comprised two separable parts having essentially identical configurations, but the core may be divided at a location that causes the two sections to have different configurations, or into three or more sections.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. An induction heating fusing device comprising:

a rotary heating member which includes a hollow portion and which is made of a conductive material;

a rotary pressure member, which is in contact with said rotary heating member, for holding between itself and said rotary heating member a recording medium carrying a toner image;

a core which forms a closed magnetic circuit and which includes a first core component which runs through the hollow portion of said rotary heating member and a second core component which is located outside the hollow portion of said rotary heating member;

an inductive coil, which is located around said first core component, for heating said rotary heating member based on induction heating;

a holder which holds said rotary heating member, said first core component and said inductive coil; and a support mechanism for detachably supporting said holder so that said holder can be separated and removed from said second core component with holding said rotary heating member, said first core component and said inductive coil.

2. An induction heating fusing device as claimed in claim 1, wherein said support mechanism includes a pressure mechanism for placing an end surface of said first core component and an end surface of said second core component in pressure contact with each other.

3. An induction heating fusing device as claimed in claim 1, wherein said rotary heating member has a hollow cylindrical configuration.

4. An image forming apparatus comprising:

an induction heating fusing device which includes:

a rotary heating member which includes a hollow portion and which is made of a conductive material;

a rotary pressure member, which is in contact with said rotary heating member, for holding between itself and said rotary heating member a recording medium carrying a toner image;

a core which forms a closed magnetic circuit and which includes a first core component which runs through the hollow portion of said rotary heating member and a second core component which is located outside the hollow portion of said rotary heating member;

an inductive coil, which is located around said first core component, for heating said rotary heating member based on induction heating; and a holder which holds said rotary heating member, said first core component and said inductive coil; and a support mechanism for supporting said induction heating fusing device in a body of the image forming apparatus, wherein said a support mechanism allows said holder, which holds said rotary heating member, said first core component and said inductive coil, to be detached from the body of the image forming apparatus with leaving said second core component in the body of the image forming apparatus.

5. An image forming apparatus as claimed in claim 4, said support mechanism includes a pressure mechanism for placing an end surface of said first core component and an end surface of said second core component in pressure contact with each other.

6. An image forming apparatus as claimed in claim 4, wherein said rotary heating member has a hollow cylindrical configuration.

* * * * *